US005134911A

United States Patent [19]

Busky et al.

[11] Patent Number: 5,134,911

[45] Date of Patent: Aug. 4, 1992

[54] METHOD FOR THE INTERRUPTED CUTTING OF A LINE IN SHEET MATERIAL

[75] Inventors: Theodore J. Busky, Storrs, Conn.; Robert J. Pomerleau, Springfield, Mass.

[73] Assignee: Gerber Garment Technology, Inc., Tolland, Conn.

[21] Appl. No.: 681,555

[22] Filed: Apr. 5, 1991

[51] Int. Cl.[5] ..... B26D 3/14; D06H 7/00

[52] U.S. Cl. ..... 83/34; 83/49; 83/56; 83/940

[58] Field of Search ..... 83/34, 39, 49, 56, 937, 83/940

[56] References Cited

U.S. PATENT DOCUMENTS

| | | | |
|---|---|---|---|
| 3,541,243 | 11/1970 | Whitsel | 83/76.9 |
| 3,761,675 | 9/1973 | Mason et al. . | |
| 3,766,813 | 10/1973 | Pearl | 83/56 |
| 4,328,726 | 5/1982 | Pearl | 83/39 |
| 4,740,668 | 4/1988 | Perez | 219/121 PC |
| 4,972,745 | 11/1990 | Bruder et al. | 83/422 |
| 5,042,338 | 8/1991 | Gerber | 83/56 |
| 5,042,339 | 8/1991 | Gerber | 83/56 |

*Primary Examiner*—Hien H. Phan

*Attorney, Agent, or Firm*—McCormick, Paulding & Huber

[57] ABSTRACT

In the case of the cutting of a line in a quantity of sheet type work material where the cutting is interrupted before the line is completely cut, with the cutting tool being removed from the material at the point of interruption and later brought back into cutting engagement with the material at that point, complete and clean cutting along the desired line of cut is assured despite the interruption by ending the first cut which ends at the interruption point so that is continues slightly beyond that point along an end path and by starting the second cut along a start path which starts behind the interruption point so that the end path and start path overlap one another along a region of the desired line and by crossing each of the end and start paths with a line of cut to assure complete separation from one another of the portions of the material located on opposite sides of the desired line.

13 Claims, 4 Drawing Sheets

METHOD FOR THE INTERRUPTED CUTTING OF A LINE IN SHEET MATERIAL

FIELD OF THE INVENTION

This invention relates to a method for cutting sheet material along a desired line of cut with the cutting tool being withdrawn from the line before it is fully cut and with the cutting tool being later brought back into cutting engagement with the work material for further cutting of the desired line, and deals more particularly with a method for performing such interrupted cutting of a line with assurance that despite the interruption the material located on one side of the desired line is completely separated from the material on the other side of the line so that the portions of the material on the opposite sides of the line are not connected to one another by any uncut threads, material bridges, or the like.

BACKGROUND OF THE INVENTION

The method of this invention is one particularly useful in the cutting of pattern pieces from sheet material in the general way shown by U.S. patent application Ser. No. 07/571,077, filed Aug. 21, 1990, entitled "Method and Apparatus For Cutting Successive Segments of Sheet Material With Cut Continuation" now U.S. Pat. No. 5,042,339, wherein the sheet material to be cut is of relatively long length and is cut progressively by moving one segment of the work material to a cutting station, cutting lines in such one segment of the work material while it is positioned at the cutting station, moving the next adjacent segment of the work material to the cutting station, cutting lines in said next segment while it is positioned at said cutting station, and repeating said movement of successive segments of the work material to and the cutting of them at said cutting station until the entire length of the work material has been cut. In the cutting of pattern pieces from work material by such segment-by-segment cutting it often occurs that a pattern piece will have a portion of it falling into one segment and another portion falling into an adjacent segment so that one part of the pattern piece is cut at one time while the involved segment is at the cutting station and another portion of it is cut at a later time while the adjacent segment is at the cutting station.

Where portions of a line a:.e cut at different times, as for example in the above-described cutting of a pattern piece having portions falling in segments of work material cut at different times, positioning and cutting errors tend to occur at the points where the cutting is interrupted, so that along the portion of a line of cut extending through an interruption point the portions of the material located on opposite sides of the line may not be completely separated from one another and may instead be connected to one another by uncut threads or other material bridges. This in turn seriously hinders further processing of the cut work material, especially the step of removing cut pattern pieces from the surrounding waste material.

The general object of this invention is therefore to provide an improved method for cutting a line in work material in a case where it is necessary to interrupt the cutting and which method assures that despite the interruption the portions of the material located on opposite sides of the line are cleanly and completely separated from one another.

A further object of the invention is to provide a method achieving the preceding object and also specifically applicable to the cutting of pattern pieces from the work material and which method may, if desired, be carried out in such way as to involve no invasion of the pattern piece by the cutting tool. That is, the method can maintain, if desired, the intended geometries or shapes of the pattern pieces to be cut from the work material.

Other objects and advantages of the invention will be apparent from the following detailed description of the preferred embodiments of the invention and from the accompanying drawings and claims.

SUMMARY OF THE INVENTION

The invention resides in a method for the interrupted cutting of a continuous line in work material consisting of a single sheet or a lay-up of sheets of sheet material by a cutting machine having a cutting station and a cutting tool movable in X and Y coordinate directions relative to work material at the cutting station to cut lines in the work material. A desired continuous line to be cut in the work material is first defined and includes a continuous part, that is a substantially straight or curved part containing no sharp corner or similar discontinuity. The cutting tool is then moved in cutting engagement with the work material along a first line of cut which includes a first portion of the continuous part of the desired line extending from a first point on the desired line to a second point on the desired line and which also includes an end path extending from the second point on the desired line to an end point. The cutting tool is then withdrawn from the work material at the end point. Thereafter it is moved along a second line of cut which second line of cut includes a start path extending from a start point to a third point on the desired line and which also includes a second portion of the desired line extending from the third point to a fourth point on the desired line, with the second and third points being located on the desired line between the first and fourth points. Further, in association with the cutting of the end path and the cutting of the start path the cutting tool is so manipulated as to cause the end path to be crossed by a line of cut extending beyond both sides of it and to cause said starting path to likewise be crossed by a line of cut extending beyond both sides of it to assure complete separation of the material located on one side of the desired line from the material located on the other side of the desired line.

The line of cut crossing the end path and the line of cut crossing the start path may both be provided a third line of cut separate from said first and second lines of cut; or it may be that the line of cut crossing the end path is the start path and line of cut crossing the start path is the end path.

The invention also resides in the work material being moved relative to the cutting station while the cutting tool is withdrawn from the work material, and it also resides in the desired line of cut being one defining the periphery of a pattern piece with the described end path and starting path being located outboard of the pattern piece so that the cutting tool in carrying out the method does not invade or cut into the pattern piece defined by the desired line.

DESCRIPTION OF THE PREFERRED EMBODIMENTS

The method of this invention is useful in the cutting of sheet material and is applicable to various different kinds of cutting tools and cutting machines. For example, the cutting tool used for performing the actual cutting operation may be a reciprocating knife, an ultrasonically vibrated knife, a rotatable knife, a laser beam or a water jet. The cutting machine of which the cutting tool is a part may also, for example, be one wherein the cutting tool is moved either semi-automatically or automatically along lines of cut by a computer implemented control system using instructions derived from a set of marker data or other input data describing in X and Y coordinates the shape and arrangement of pattern pieces wanted from the sheet material.

Figure 1:
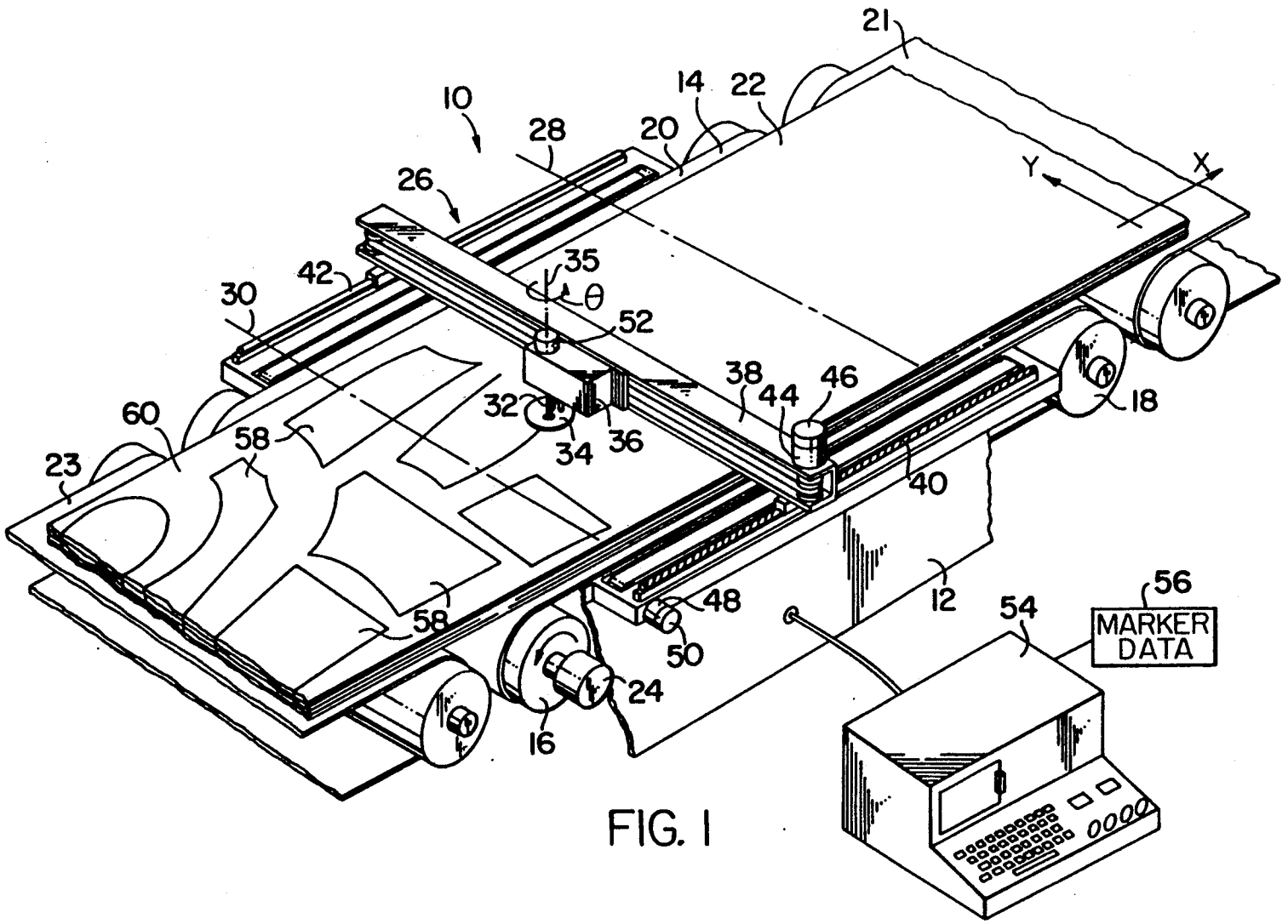
FIG. 1 is a perspective, somewhat schematic view of a cutting machine used in practicing the present invention.

Referring to FIG. 1, the invention is shown and described herein as carried out by an automatically controlled cutting machine 10 having a cutting station 26 of shorter length than the material to be cut and having a conveyor for supporting the work material at the cutting station and for moving it lengthwise relative to the frame of the machine to bring successive segments of the material to the cutting station. This machine 10 includes a stationary frame 12 and an endless belt-like conveyor member 14 trained about rolls 16 and 18. The conveyor member 14 may for example be of the type shown in U.S. Pat. No. 4,328,723 wherein the member is made up of a large number of transversely extending bristle block carrying grids or slats pivotally connected to one another and wherein the rolls 16 and 18 are of suitable sprocket-like shape for positive driving cooperation with the conveyor member. In any event, the conveyor member 14 provides, along its upper run, an upwardly facing supporting surface 20 for supporting work material 22 shown as a lay-up of a number of superimposed sheets cf sheet material. The forward roll 16 is powered by a drive motor 24 which rotates the roll in the counter-clockwise direction illustrated by the arrow to move the work material 22 along the illustrated X coordinate axis or toward the left as viewed in FIG. 1.

Various different means may be used with the machine 10 for assisting in bringing work material to and taking it from the cutting station 26. In the illustrated case of FIG. 1 these means include a feed conveyor 21 and a take-away conveyor 23 which may be cf types well known in the art and which may be driven in unison with the conveyor member 14. In the alternative, the illustrated conveyor member 14 may be lengthened at either or both ends of the machine 10 to take the place of the separate feed conveyor 21 and/or the take-away conveyor 23.

The cutting station 26 has an effective range in the X coordinate direction defined by the limit lines 28 and 30, and has a range in the Y coordinate direction approximately equal to the width of the conveyor member 14. At the cutting station is a cutting tool 32 moveable in the X and Y coordinate directions over the full area of the cutting station to cut lines in the segment of work material positioned at the cutting station.

In the illustrated case the cutting tool 32 is a reciprocating knife cooperating with a presser foot 34 and reciprocated along a cutting axis 35 extending generally perpendicularly to the plane of the supporting surface 20. The cutting tool and the presser foot are carried by a cutter head 36, in turn carried by a main carriage 38 for movement relative thereto in the illustrated Y coordinate direction. The main carriage straddles the conveyor member 14 and at each of its opposite ends is supported by suitable longitudinally extending guides 40, 42 for movement in the X coordinate direction relative to the frame 12. A Y drive means including a motor 44 and a Y encoder 46 drives the cutter head 36 in the Y coordinate direction relative to the main carriage 38; and an X drive means including a motor 48 and an X encoder 50 drives the main carriage 38 in the X coordinate direction. A reciprocating motor (not shown) in the cutter head drives the cutting tool 32 in its reciprocating motion, and another motor (not shown) rotates the cutting tool, under control of the controller 54, in the direction about the axis 35 to keep the tool facing forwardly along the line of cut. A solenoid 52 carried by the cutter head 36 is operable to move the cutter head frame and therewith the cutting tool 32 and the presser foot 34, between a lowered position at which the cutter tool is in cutting engagement with the material 22 and a raised position at which the tool is out of cutting engagement with the material 22.

The machine 10 is controlled by a computer implemented controller 54 which supplies the necessary commands to the machine to operate the X and Y motors 48 and 44, the solenoid 52 and other parts of the machine so that the tool 32 is moved along desired lines of cut relative to the work material positioned at the cutting station 26. The control commands supplied by the controller 54 are generated in response to marker data, indicated representationally at 56, describing in terms of X and Y coordinates the shape and arrangement of pattern pieces 58 to be cut from the work material. A method and system for producing such marker data is, for example, described in U.S. Pat. No. 3,887,903. The data may be supplied either on line directly to a memory in the controller 54 or may be supplied to the controller prerecorded on a tape, disc or other memory medium. In the operation of the machine 10, after a segment of the work material is positioned at the work station 26 the cutting tool is moved in the X and Y coordinate directions to cut lines in such segment, such lines usually being the peripheries of desired pattern pieces 58 After the segment is fully cut the cutting operation is interrupted, the drive motor 24 is operated to bring the next succeeding segment of work material to the work station and then the cutting tool 32 is operated again to cut lines in the fresh segment. Such segment-by-segment cutting is continued until all of the desired pattern pieces have been cut.

Following the cutting of pattern pieces by the cutting tool 32 the pattern pieces are removed from the adjacent waste material 60 either by picking up the cut pattern pieces by hand or by using a mechanical separating means. To facilitate this separation it is essential that the pattern pieces be cleanly cut and separated from the waste material with there being no uncut fibers, strings or bridges connecting the pattern pieces to the waste material.

Non-clean cutting tends to occur in segment-by-segment cutting of the work material when a pattern piece to be cut from the material has one part falling in one segment and another part falling in a following segment. Such a situation, and a related cutting procedure as known in the prior art, is shown, for example, in FIGS. 2 and 3. In those figures, the illustrated pattern piece 58 has one part located in a first segment 74 of the work material 22 and another part located in the following segment 76 of the work material. In advancing a fresh segment to the cutting station the material 22 is moved to the left parallel to the X coordinate direction as indicated by the arrow M. The line 73 is the dividing line between the illustrated segments 72 and 74; the line 75 is the dividing line between the segments 74 and 76; and the line 77 is the dividing line between the segment 76 and 78. Each segment has a length $L_s$ which for convenience of illustration is shown to be only slightly smaller than the effective length $L_{cs}$ of the cutting station 26 so that when a segment is positioned at the cutting station the two dividing lines (such as the lines 73 and 75 of FIG. 2) are each spaced slightly inboard from the adjacent limit lines 30 and 28 of the cutting station. In the cutting procedure of the prior art this is not however necessary and if desired the segment length $L_s$ may be equal to the cutting station length $L_{cs}$ with a segment positioned at the cutting station having its dividing or end limit lines collinear with the limit lines 30 and 28 of the cutting station.

Figure 2:
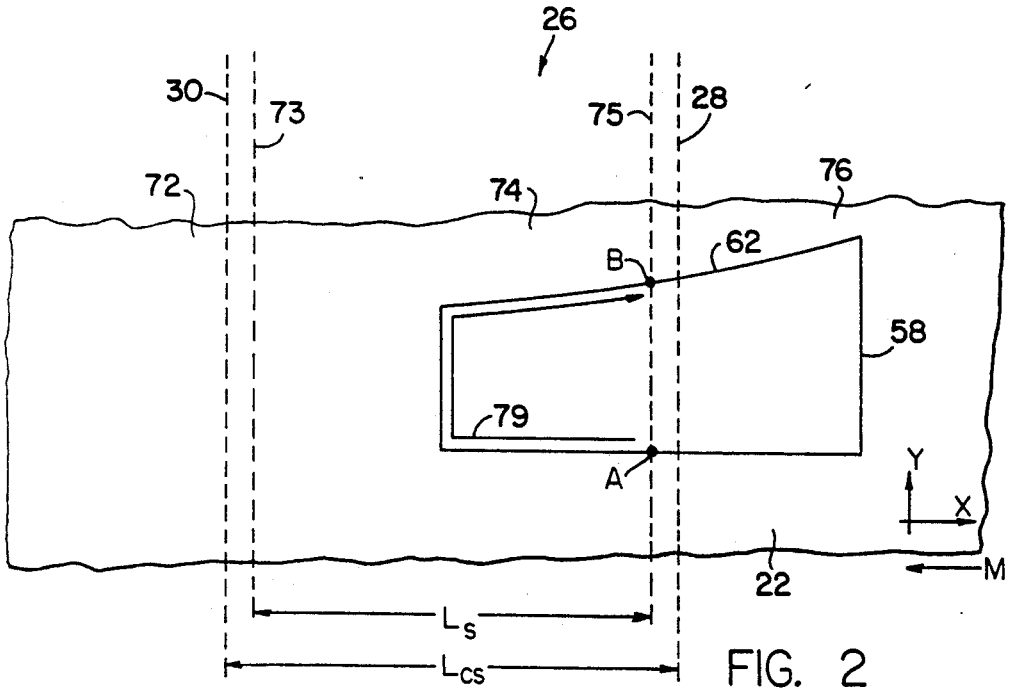
FIG. 2 PRIOR ART
FIGS. 2 and 3 are fragmentary plan views of a portion of work material cut by the machine of FIG. 1 and illustrating a known method of cutting.
Figure 3:
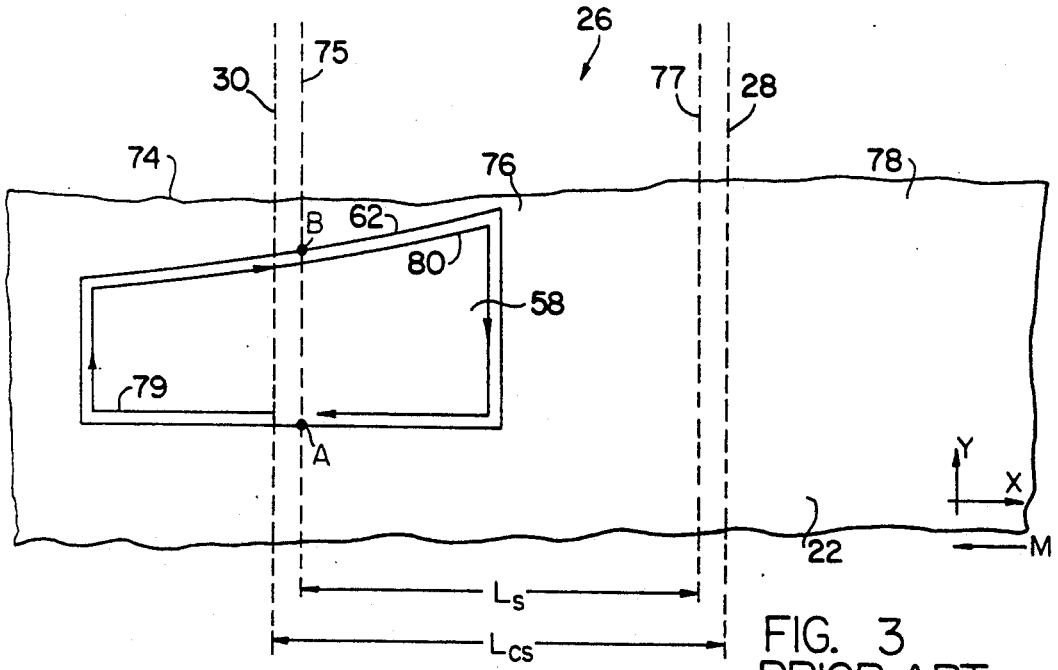
FIG. 3 PRIOR ART

In the conventional cutting of the illustrated pattern piece 58 of FIGS. 2 and 3 the part located in the segment 74 is cut while that segment is located at the cutting station 26 with the tool being inserted into the material at the point A on the desired peripheral line 62 and moved in cutting engagement with the material along the line 62, in the clockwise direction and as indicated generally by the arrowed line 79 to the point B. At the point B the tool is removed from cutting engagement with the material and may be used, if necessary, to cut other lines appearing in the segment 74 while that segment is still at the cutting station 26. When all of the lines in the segment 74 have been cut the material is advanced relative to the machine frame 12, by operation of the conveyor element 14, to bring the following segment 76 to the cutting station. At some time while the segment 76 is at the cutting station the cutting of the illustrated pattern piece 58 is continued and completed by re-engaging the cutting tool with the material at the point B and cutting along the remainder of the desired peripheral line 62 by moving the tool from the point B to the point A along the line 62, as indicated generally by the arrowed line 80.

Still with reference to FIG. 3, when the knife is withdrawn from the point B the material tends to relax rearwardly, and also some shifting or mispositioning of the material may take place during the advancement of the fresh segment 76 to the cutting station. Some possibility therefore exists for obtaining non-clean cutting when the knife is re-inserted at point B to finish the cutting of the pattern piece. Similarly, when the cutting tool returns to the point A in FIG. 3 the material in the vicinity of that point may also be somewhat displaced due to relaxation, to shift or mispositioning during advancement, or to the force exerted by the tool on the material as it approaches the point A, creating some possibility for non-clean cutting at the point A.

In FIGS. 2 and 3 the points A and B are points at which the segment dividing line 75 intersects continuous parts of the desired line of cut represented by the peripheral line 62 of the illustrated pattern piece 58. The points A and B are therefore transition points at which continuous parts of the desired peripheral line 62 pass between the adjacent work material segments 74 and 76, and in the cutting method of FIGS. 2 and 3 they are the exact points at which the cutting is interrupted.

In accordance with the invention, the two lines of cut which meet or nearly meet at a transition point respectively follow end and start paths which end and start respectively at end and start points spaced some distance from the transition point, and each of said end path and start path is crossed by a line of cut which extends a substantial distance beyond both sides of it to assure clean separation from one another of the portions of the material located on opposite sides of the desired line of cut. That is, at a transition point the first line of cut which ends at that transition point instead of stopping exactly at the transition point is continued beyond the transition point along an end path to an actual end point and the second line of cut which nominally starts at the involved transition point instead of starting exactly at that point starts at a start point spaced behind the transition point so that the end path and start path overlap one another along a region of the desired line of cut, and each of these paths is crossed by a line of cut intersecting it within the overlap region. The line of cut crossing the end and start paths may be a third line of cut separate from the first and second lines of cut; or the end path may be crossed by the start path and the start path crossed by the end path.

Figure 4:
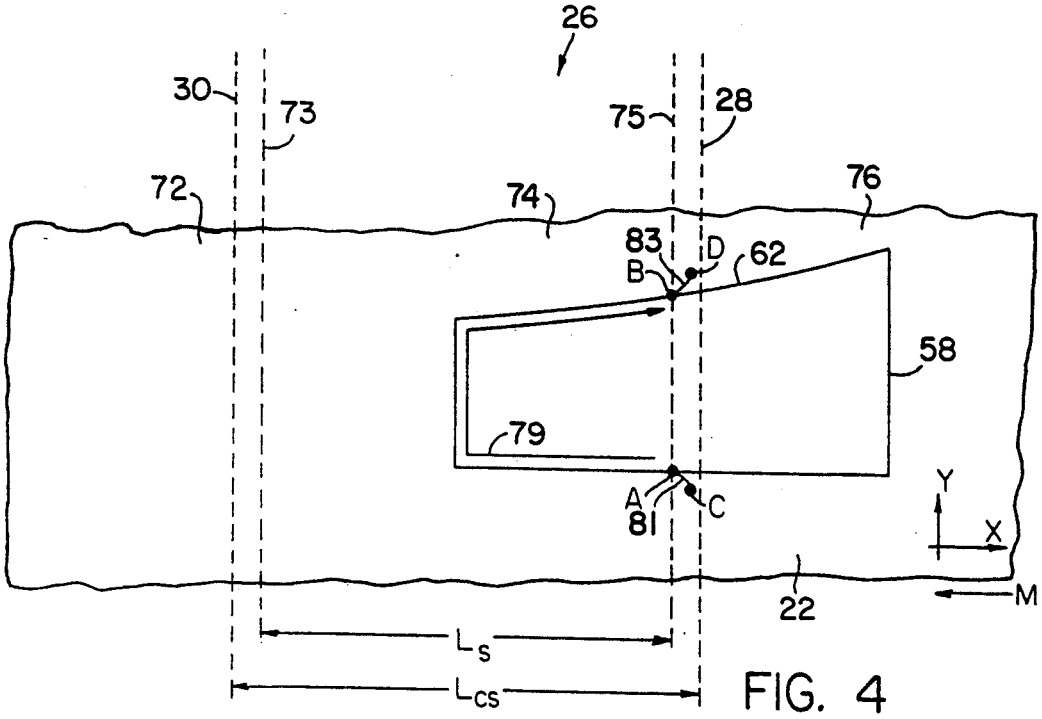
FIGS. 4 and 5 are fragmentary plan views similar to FIGS. 2 and 3 but illustrating the rutting method of the invention.
Figure 5:
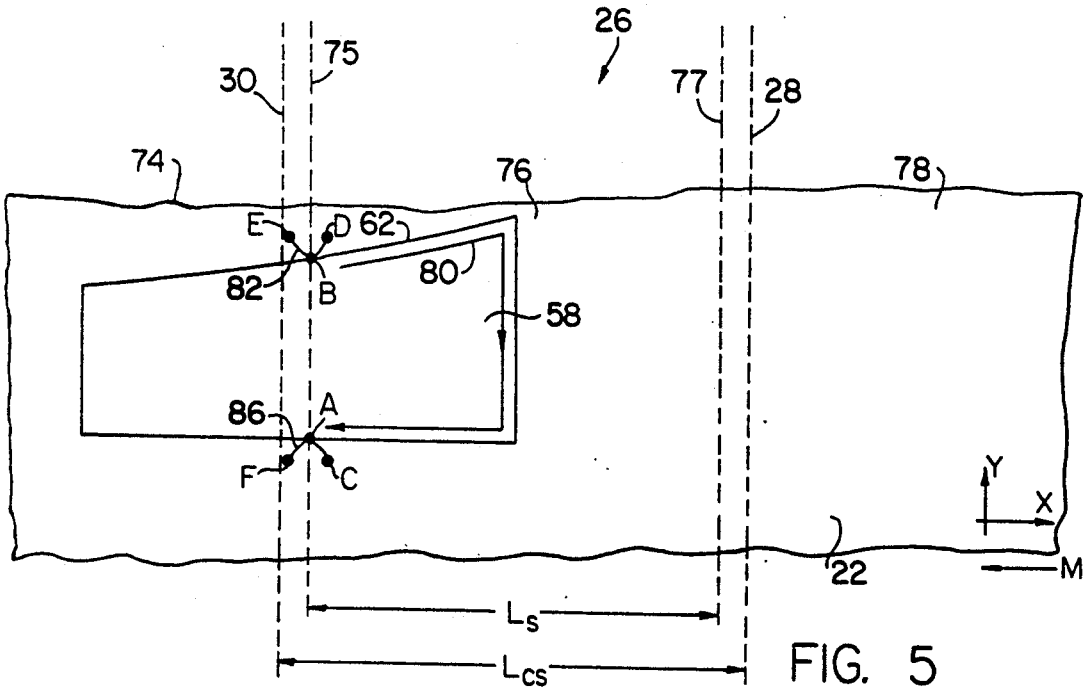

The above-described cutting method of the invention is explained further with reference to FIGS. 4 and 5. Turning first to FIG. 4, when the work material 22 is positioned as there shown the pattern piece 58 has a peripheral line 62 defining a desired line of cut, and this desired line of cut has one portion lying in the segment 74 to the left of the dividing line 75 and another portion located in the segment 76 to the right of the dividing line 75. Also, within the vicinity of each of the points A and B the desired line is continuous, that it has no sharp curves or similar discontinuities. While the work material is positioned as in FIG. 4 the portion of the desired line 62 lying in the segment 74 is cut by first moving the cutting tool to a start point C located in advance of the transition point A, with respect to the intended clockwise direction of cutting, and also located a substantial distance outboard of the pattern piece 58. The cutting tool is then moved along a start path 81 to the transition point A and after reaching the point A it is moved along the desired line of cut 62, as indicated generally by the arrow 79, to the transition point B. After reaching the transition point B the cutter is maintained in cutting engagement with the work material and moved along an end path 83, deviating from the line 62, to an end point D located outboard of the pattern piece 58. Thus, the line of cut executed while the work material is positioned as shown in FIG. 4 is the illustrated line CABD following the direction of the arrow 79.

After the cutting tool reaches the end point D it is removed from cutting engagement with the material and then, or at some later time, the material is moved in the direction M to bring the next segment 76 of the material to the work station 26 as shown in FIG. 5. While the material is positioned as shown in FIG. 5 the remainder of the pattern piece 58 is cut by executing a second line of cut. This second line of cut starts at a start point E located outboard of the desired line of cut 62 and follows a start path 82, deviating from the desired line 62, to the transition point B. After reaching the transition point B the cutter is moved to cut along the desired line 62 from the transition point B to the transition point C as indicated by the arrowed line 84. Upon reaching the transition point A the cutter is maintained in cutting engagement with the work material and moved to an end point F along an end path 86 deviating from the desired line 62. The second line of cut therefore consists of the line EBAF following the direction of the arrow 84 as seen in FIG. 5. Upon reaching the end point F the cutting of the pattern piece 58 is complete and the cutting tool is removed from cutting engagement with the material 22.

With reference to FIG. 5 it will therefore be understood that in the vicinity of each of the transition points A and B the two lines of cut which begin and end at that point cross one another at a substantial angle in the vicinity of the transition point and therefore assure complete cutting of all threads and the like which might otherwise connect the pattern piece to the surrounding waste material. It will also be appreciated from FIG. 5 that if the work material shifts slightly in either or both of the X and Y coordinate directions during the advancement of the segment 76 to the cutting station, or if other positioning errors occur, so that the portion of the peripheral line 62 cut in the segment 74 does not exactly register as intended with the portion of the line 62 cut in the segment 76, the end path and start path at the point A and the end path and the start path at the point B will nevertheless still cross one another to assure complete separation of the pattern piece from the waste material. Also, as seen in FIG. 5, all of the start paths 81 and 82 and end paths 83 and 86 are located outboard of the pattern piece 58, thereby maintaining the intended shape and geometry of that pattern piece. However, in some instances the invasion of a pattern piece by one or more of the end and starting paths may be tolerated and if so such end and start paths may, if desired, be arranged so that one or more of them does extend into the pattern piece.

Figure 9:
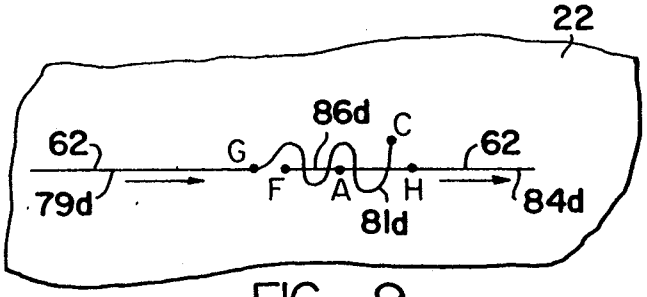
FIGS. 6 to 11 are fragmentary plan views of a portion of sheet material cut by the machine of FIG. 1 and illustrate alternative ways of maneuvering the cutting tool in accordance with the invention at an interruption point.
Figure 10:
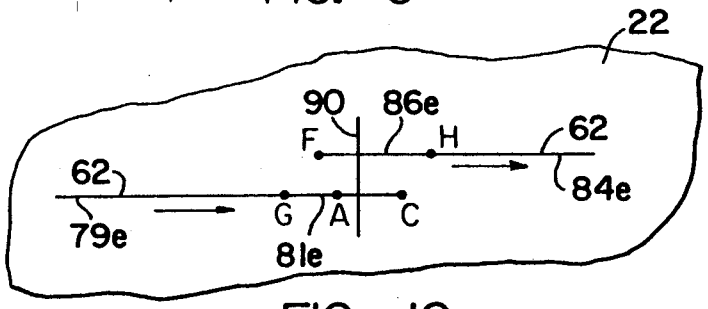
Figure 11:
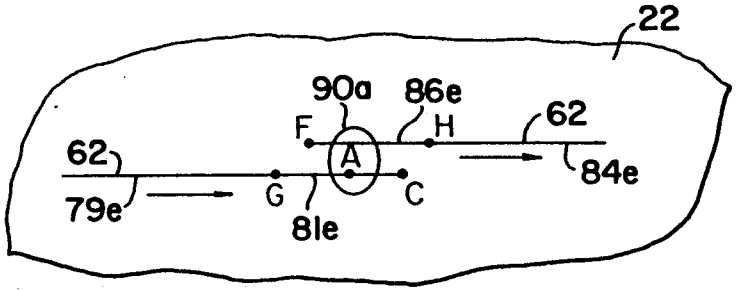

FIGS. 7 to 11 show other ways in which the cutting tool may be maneuvered in the vicinity of a transition point in accordance with the invention to assure complete separation of the material on one side of the desired line of cut from the material on the other side of that line. FIGS. 6 to 9 illustrate situations wherein, as in FIG. 5, at the involved transition point the end path of the first line of cut is crossed by the start path of the second line of cut and the start path of the second line of cut is crossed by the end path of the first line of cut. FIGS. 10 and 11 on the other hand illustrate cases in which the end path and start path are crossed by a third line of cut separate from the first and second lines of cut.

Figure 6:
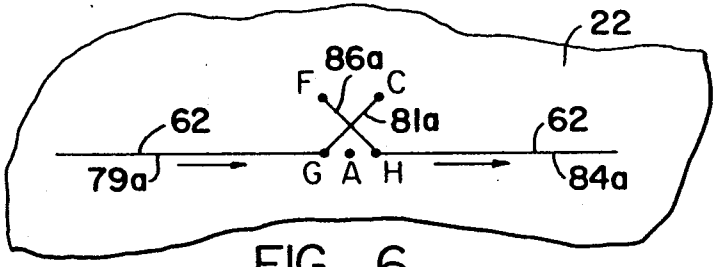

Turning to FIG. 6 the first line of cut **79*a* has an end path 81*a* extending from a point G on the desired line 62 to a end point C, and the second line of cut 84*a* has a start path 86*a* extending from the start point F to a point H on the desired line 62 with the point G and H both being spaced from the transition point A as shown. The type of cut shown in FIG. 6 is one which may sometimes be obtained when attempting to cut in the manner shown by FIG. 5 but with the work material shifting undesirably in the X-coordinate direction during the advancement of the material from the FIG. 4 position to the FIG. 5** position.

Figure 7:
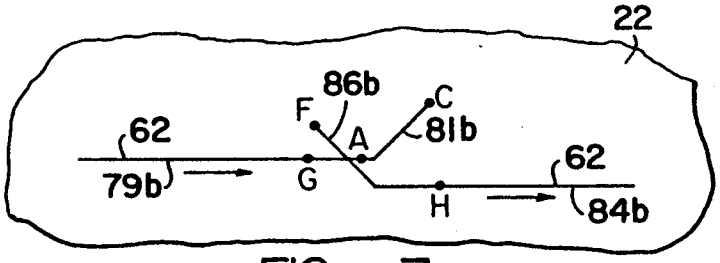

FIG. 7 illustrates a manner of cutting substantially similar to that of FIGS. 5 and 6 and which can be taken to represent an attempt to cut in accordance with the method of FIG. 5 but with the material shifting both in the X and Y coordinate directions during the related advancement of the work material. In FIG. 7, the first line of cut **79*b* has an end path 78*b* which extends from the illustrated point G on the desired line of cut 62 to the end point C and the second line of cut 84*b* has a start path 86*b* extending from the start point F to a point H on the desired line 62**.

Figure 8:
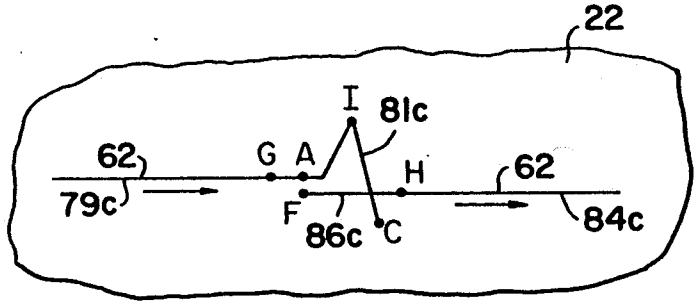

Referring to FIG. 8, in the method of cutting there shown the first line of cut **79*c* includes an end path 81*c* extending from the point G to the end point C with such end path first extending to one side of the desired line 62 to a point I and then extending from the point I to the end point C located on the opposite side of the line 62. The second line of cut 84*c* includes a start path 86*c* extending from the illustrated start point F to the point H, with the start path 86*c* being located substantially on or parallel to the desired line of cut 62**.

In FIG. 9 the illustrated manner of cutting includes a first line of cut **79*d* having an end path 81*d* extending from the point G to the end point C with the end path 81*d* being a sinuous one passing a number of times from one side to the other of the desired line 62. The second line of cut 84*d* in turn includes a start path 86*d* extending from the start point F to the point H on the line 62 with the start path 86*d* being generally straight and located on or parallel to the desired line 62**.

In FIG. 10 the first line of cut **79*e* includes an end path 81*e* extending from the point G to the end point C with the end path 81*e* being located on or generally parallel to the desired line 62. The second line of cut 84*e* includes a start path 86*e* extending from the start point F to the point H with the start path 86*e* being generally on or parallel to the desired line 62. The end point C is located beyond the transition point A and the start point F is located behind the transition point A so that the end path 81*e* and start path 86*e* overlap one another along a region of the desired line 62. Within this region of overlap a third line of cut 90 is made by the cutting tool so as to intersect both the end path 81*e* and the start path 86*e* and to extend a substantial distance to either side of the path 81*e* and to either side of the path 86*e***.

The cutting method of FIG. 11 is substantially similar to that of FIG. 10 except that the third line of cut **90*a* is a closed line such as a circle or ellipse crossing each of the end path 81*e* and the start path 86*e* two times. The third line 90*a* may be cut with the cutting tool 32; however, it may also, if desired, be cut by a drill or punch or similar tool carried by the cutter head 36**.

Of court, it will be understood that many other specific ways, different from those of FIGS. 5 to 11, may be used for maneuvering the cutting tool in the vicinity of an interruption point while remaining within the broader aspects of the invention as defined by the following claims.

We claim:

1. A method of cutting a line in work material consisting of a single sheet or a lay-up of sheets of sheet material, said method comprising the steps of:

providing a cutting machine having a cutting station and a cutting tool movable in X and Y coordinate directions relative to work material at said cutting station to cut lines in said work material, providing a quantity of work material to be cut at said cutting station, defining a desired line to be cut in said work material and having a continuous part, moving said cutting tool in cutting engagement with said work material forwardly along a first line of cut, said first line of cut including a first portion of said continuous part of said desired line extending from a first point on said desired line to a second point on said desired line and also including an end path extending from said second point on said desired line to an end point, withdrawing said cutting tool from said work material at said end point, advancing said work material in said X coordinate direction after said cutting tool is withdrawn from said work material at said end point, then moving said cutting tool in cutting engagement with said work material forwardly along a second line of cut, said second line of cut including a start path extending from a start point to a third point on said desired line and also including a second portion of said continuous part of said desired line extending from said third point to a fourth point on said desired line, with said second and third points being located on said desired line between said first and fourth points, and in association with the cutting of said end path and said start path maneuvering said cutting tool so that said end path is crossed by a line of cut extending beyond both sides of it and so that said start path is crossed by a line of cut extending beyond both sides of it to assure complete separation of the material located on one side of said desired line from the material located on the opposite side of said desired line.

2. The method defined in claim 1 further characterized by:

said line of cut crossing said end path and said line of cut crossing said start path both being part of a third line of cut separate from said first and second lines of cut.

3. The method defined in claim 2 further characterized by:

said end path and said start path extending generally along said desired line of cut and overlapping one another along a region of overlap, and said third line of cut crossing said end path and said start path at points within said region of overlap.

4. The method defined in claim 1 further characterized by:

said line of cut crossing said end path being said start path, and said line of cut crossing said start path being said end path.

5. The method defined in claim 4 further characterized by:

one of said end and start paths extending generally along said desired line of cut, and the other of said end and start paths deviating from said desired line of cut.

6. The method defined in claim 5 further characterized by:

said other of said end and start paths deviating from said desired line of cut along a line which first extends from said desired line to a point spaced laterally from one side of said desired line and which then extends from said latter point to a point spaced laterally from the other side of said desired line.

7. The method defined in claim 4 further characterized by:

both said end path and said start path deviating from said desired line of cut.

8. The method defined in claim 4 further characterized by:

both said end path and said start path deviating laterally in the same direction away from said desired line.

9. A method of cutting a line in work material consisting of a single sheet or a lay-up of sheets of sheet material, said method comprising the steps of:

providing a cutting machine having a cutting station and a cutting tool movable in X and Y coordinate direction relative to work material at said cutting station to cut lines in said work material;

providing a quantity of work material to be cut at said cutting station, defining a desired continuous line to be cut in said work material and having a continuous part, moving said cutting tool in cutting engagement with said work material along a first line of cut, said first line of cut including a first portion of said continuous part of said desired line extending from a first point on said desired line to a second point on said desired line and also including an end path deviating from said desired line and extending from said second point on said desired line to an end point spaced a substantial distance laterally from said desired line on one side of said desired line, withdrawing said cutting tool from said work material at said end point, advancing said work material in said X coordinate direction after said cutting tool is withdrawn from said work material at said end point, and then moving said cutting tool along a second line of cut in cutting engagement with said work material, said second line of cut including a start path deviating from said desired line and extending from a start point located on said one side of said desired line and spaced a substantial distance laterally from said desired line to a third point on said desired line and also including a second portion of said desired line extending from said third point to a fourth point on said continuous part of said desired line, with said second and third points being located on said desired line between said first and fourth points, so that said first and second lines of cut cross one another in the vicinity of said second and third points.

10. A method of cutting a line in work material consisting of a single sheet or a lay-up of sheets of sheet material, said method comprising the steps of:

providing a cutting machine having a cutting station and a cutting tool movable in X and Y coordinate directions relative to work material at said cutting station to cut lines in said work material, providing a quantity of work material to be cut at said cutting station, defining a desired line to be cut in said work material and having a continuous part, moving said cutting tool forwardly along said desired line from a first point on said continuous part of said desired line to a second point on said continuous part of said desired line while in cutting engagement with said work material to cut a first portion of said desired line, after said tool reaches said second point continuing to move said tool in cutting engagement with said work material along an end path extending generally forwardly with respect to said desired line from said second point and deviating laterally outwardly from one side of said desired line to an end point laterally spaced a substantial distance from said desired line on said one side thereof, after said cutting tool reaches said end point withdrawing said tool from cutting engagement with said work material, advancing said work material in said X coordinate direction after said cutting tool is withdrawn from said work material at said end point, moving said tool to a start point located rearwardly of said second point with respect to said desired line of cut and also laterally spaced a substantial distance from said desired line on said one side thereof, moving said tool from said start point in cutting engagement with said work material along a start path extending from said start point generally forwardly with respect to said desired line and laterally inwardly to a third point on said continuous part of said desired line, and then after said tool reaches said third point moving it forwardly along said desired line from said third point in cutting engagement with said work material to cut a second portion of said continuous part of said desired line.

11. A method of cutting a line in work material consisting of a single sheet or a lay-up of sheets of sheet material, said method comprising the steps of:

providing a cutting machine having a machine frame, a cutting station fixed relative to said machine frame, and a cutting tool movable relative to said machine frame at said cutting station in X and Y coordinate directions to cut lines in material located at said cutting station, providing a quantity of work material having a length in said X coordinate direction greater than the length of said cutting station in said X coordinate direction, defining a desired line to be cut in said work material and having a continuous part, positioning said work material so that a portion of said desired line is located at said cutting station, moving said cutting tool forwardly along said desired line from a first point on said continuous part of said desired line to a second point on said continuous part of said desired line while in cutting engagement with said work material, after said tool reaches said second point continuing to move said tool in cutting engagement with said work material along an end path extending generally forwardly with respect to said desired line from said second point and deviating laterally outwardly from one side of said desired line to an end point laterally spaced a substantial distance from said desired line on said one side thereof, after said cutting tool reaches said end point withdrawing said tool from cutting engagement with said work material, advancing said material in said X coordinate direction relative to said machine frame to bring another portion of said desired line to said cutting station, moving said tool to a start point located rearwardly of said second point with respect to said desired line of cut and also laterally spaced a substantial distance from said desired line on said one side thereof, thereafter moving said tool from said start point in cutting engagement with said work material along a start path crossing said end path and extending from said start point generally forwardly with respect to said desired line and laterally inwardly to a third print on said continuous part of said desired line, and then after said tool reaches said third point moving it forwardly along said desired line from said third point in cutting engagement with said work material to cut said another portion of said continuous part of said desired line.

12. A method for cutting a pattern piece or a stack of pattern pieces from work material consisting of a single sheet or a lay-up of sheets of sheet material, said method comprising the steps of:

providing a cutting machine having a cutting station and a cutting tool movable in X and Y coordinate directions relative to work material at said cutting station to cut lines in said work material, providing a quantity of work material to be cut at said cutting station, defining a desired line on said work material describing the periphery of a pattern piece and including a transition point, moving said cutting tool in cutting engagement with said work material along a first line of cut which first line of cut includes a portion of said desired line ending at a point near said transition point and which first line of cut also includes an end path extending from said desired line to an end point spaced laterally from one side of said desired line, withdrawing said cutting tool from cutting engagement with said work material at said end point, advancing said work material in said X coordinate direction after said cutting tool is withdrawn from said work material at said end point, and then moving said cutting tool in cutting engagement with said work material along a second line of cut including a start path extending from a start point spaced laterally from said one side of said desired line to said desired line and also including another portion of said desired line starting near said transition point, said first and second lines of cut crossing one another in the vicinity of said transition point to assure complete separation of the material located on one side of said desired line from the material located on the opposite side of said desired line.

13. A method for cutting a pattern piece or a stack of pattern pieces from work material consisting of a single sheet or a lay-up of sheets of sheet material, said method comprising the steps of:

providing a cutting machine having a machine frame, a cutting station fixed relative to said machine frame, and a cutting tool movable relative to said machine frame at said cutting station in X and Y coordinate directions to cut lines in work material located at said cutting station, providing a quantity of work material having a length in said X coordinate direction greater than the length of said cutting station in said X coordinate direction, defining a desired line to be cut in said work material which desired line describes the periphery of a pattern piece having a first portion located in a first segment of said material and a second portion located in an adjacent second segment of said material, said first and second segments being separated from one another by a dividing line intersecting said desired line at first and second transition points at which said desired line passes between said first and second segments, positioning said work material so that said first segment is located at said cutting station, moving said cutting tool to a first start point located in said second segment and which first start point is spaced rearwardly of said first transition point with respect to the direction of said desired line and is also spaced laterally from said desired line, moving said cutting tool in cutting engagement with said work material along a first start path extending from said first start point to said first transition point, moving said cutting tool in cutting engagement with said work material along said desired line from said first transition point t said second transition point to cut the portion of said desired line located in said first segment, moving said cutting tool in cutting engagement with said work material along a first end path extending from said second transition point to a first end point located in said second segment, which first end point is spaced forwardly of said second transition point with respect to the direction of said desired line, after said cutting tool reaches said first end point withdrawing said tool from cutting engagement with said work material, advancing said material in said X coordinate direction relative to said machine frame to bring said second portion of said material to said cutting station, moving said tool to a second start point located in said first segment and which second start point is spaced rearwardly of said second transition point with respect to the direction of said desired line and is also spaced laterally from said desired line in the same direction as said first end point, moving said cutting tool in cutting engagement with said work material along a second start path extending from said second start point to said second transition point so that said first end path and said second start path cross one another, moving said cutting tool in cutting engagement with said work material along said desired line from said second transition point to said first transition point to cut the portion of said desired line located in said second segment, and moving said cutter tool in cutting engagement with said work material along a second end path extending from said first transition point to a second end point located in said first segment, which second end point is spaced forwardly of said first transition point with respect to the direction of said desired line and is also spaced laterally from said desired line in the same direction as said first start path so that said first start path and said second end path cross one another.

* * * * *